US009117388B2

(12) United States Patent
Cha et al.

(10) Patent No.: US 9,117,388 B2
(45) Date of Patent: Aug. 25, 2015

(54) LIGHT SOURCE MODULE AND DISPLAY DEVICE INCLUDING THE SAME

(75) Inventors: Han Moe Cha, Anyang-si (KR); Yong-Hoon Kwon, Suwon-si (KR); Jung Kyun Kim, Seoul (KR); Ju Young Yoon, Seoul (KR)

(73) Assignee: Samsung Display Co., Ltd., Yongin (KR)

( * ) Notice: Subject to any disclaimer, the term of this patent is extended or adjusted under 35 U.S.C. 154(b) by 419 days.

(21) Appl. No.: 13/540,411

(22) Filed: Jul. 2, 2012

(65) Prior Publication Data

US 2013/0241962 A1 Sep. 19, 2013

(30) Foreign Application Priority Data

Mar. 14, 2012 (KR) ..... 10-2012-0026074

(51) Int. Cl.

| | |
|---|---|
| ***G09G 5/00*** | (2006.01) |
| ***G09G 3/00*** | (2006.01) |
| ***G09G 3/34*** | (2006.01) |

(52) U.S. Cl.

CPC ..... *G09G 3/003* (2013.01); *G09G 3/342* (2013.01); *G09G 2310/024* (2013.01); *G09G 2320/0242* (2013.01); *G09G 2320/041* (2013.01)

(58) Field of Classification Search

CPC ..... G09G 3/3406–3/3426; G02F 1/1136–1/133615

USPC ..... 345/102

See application file for complete search history.

(56) References Cited

U.S. PATENT DOCUMENTS

| | | | | |
|---|---|---|---|---|
| 7,387,421 | B2 | 6/2008 | Lee et al. | |
| 7,537,371 | B2 | 5/2009 | Okada et al. | |
| 7,671,832 | B2 * | 3/2010 | Lankhorst et al. | 345/102 |
| 8,009,247 | B2 | 8/2011 | Oku et al. | |
| 2001/0052891 | A1 * | 12/2001 | Yoshihara et al. | 345/102 |
| 2002/0167016 | A1 * | 11/2002 | Hoelen et al. | 257/89 |
| 2004/0227869 | A1 * | 11/2004 | Martynov et al. | 349/61 |
| 2005/0117320 | A1 * | 6/2005 | Leu et al. | 362/31 |
| 2005/0276075 | A1 * | 12/2005 | Chen et al. | 362/615 |
| 2006/0256257 | A1 * | 11/2006 | Nakano et al. | 349/80 |
| 2009/0097240 | A1 | 4/2009 | Egawa | |
| 2009/0267890 | A1 * | 10/2009 | Park et al. | 345/102 |
| 2009/0279286 | A1 | 11/2009 | Chen et al. | |
| 2010/0053496 | A1 * | 3/2010 | Park et al. | 349/61 |
| 2011/0001693 | A1 | 1/2011 | Kim et al. | |
| 2011/0050602 | A1 | 3/2011 | Jeong et al. | |
| 2011/0090141 | A1 * | 4/2011 | Liao et al. | 345/102 |
| 2011/0134365 | A1 | 6/2011 | Kim | |

FOREIGN PATENT DOCUMENTS

| | | |
|---|---|---|
| JP | 2009-117272 | 5/2009 |
| KR | 10-2004-0080248 | 9/2004 |

(Continued)

*Primary Examiner* — Dorothy Harris

(74) *Attorney, Agent, or Firm* — H.C. Park & Associates, PLC

(57) ABSTRACT

An approach is provided for a light source module and a display device including the same. The light source module includes two first light source packages configured to emit light of a first color, one or more second light source packages disposed between the two first light source packages, and a plurality of third light source packages disposed between the two first light source packages and alternately arranged with the one or more second light source packages. The one or more second light source packages are configured to emit light of the first color and the plurality of third light source packages are configured to emit light of a second color. An intensity of light emitted from each of the one or more second light source packages is approximately twice an intensity of light emitted from each of the two first light source packages.

21 Claims, 15 Drawing Sheets

(56) References Cited

FOREIGN PATENT DOCUMENTS

| | | |
|---|---|---|
| KR | 10-0613218 | 8/2006 |
| KR | 10-0819652 | 3/2008 |
| KR | 10-2008-0078224 | 8/2008 |
| KR | 10-2010-0030878 | 3/2010 |
| KR | 10-2011-0078168 | 7/2011 |
| KR | 10-2013-0011404 | 1/2013 |

* cited by examiner

FIG.9

| First and second light source packages | | Third light source package | Constitution of channel |
|---|---|---|---|
| Number of light source packages | Number of first light emitting elements | Number of light source packages | |
| 23 | 44 | 22 | O |
| 24 | 46 | 23 | X |
| 25 | 48 | 24 | O |
| 26 | 50 | 25 | O |
| 27 | 52 | 26 | O |
| 28 | 54 | 27 | O |
| 29 | 56 | 28 | O |
| 30 | 58 | 29 | X |
| 31 | 60 | 30 | O |
| 32 | 62 | 31 | X |
| 33 | 64 | 32 | O |
| 34 | 66 | 33 | O |
| 35 | 68 | 34 | O |
| 36 | 70 | 35 | O |
| 37 | 72 | 36 | O |
| 38 | 74 | 37 | X |
| 39 | 76 | 38 | O |
| 40 | 78 | 39 | O |
| 41 | 80 | 40 | O |
| 42 | 82 | 41 | X |

FIG.11

| Number of first type light source packages | Number of second type light source packages | Constitution of channel |
|---|---|---|
| 23 | 22 | X |
| 24 | 23 | X |
| 25 | 24 | O |
| 26 | 25 | O |
| 27 | 26 | O |
| 28 | 27 | O |
| 29 | 28 | X |
| 30 | 29 | X |
| 31 | 30 | X |
| 32 | 31 | X |
| 33 | 32 | O |
| 34 | 33 | O |
| 35 | 34 | O |
| 36 | 35 | O |
| 37 | 36 | X |
| 38 | 37 | X |
| 39 | 38 | O |
| 40 | 39 | O |
| 41 | 40 | X |
| 42 | 41 | X |

LIGHT SOURCE MODULE AND DISPLAY DEVICE INCLUDING THE SAME

CROSS-REFERENCE TO RELATED APPLICATION

This application claims priority from and the benefit of Korean Patent Application No. 10-2012-0026074, filed on Mar. 14, 2012, which is hereby incorporated by reference for all purposes as if fully set forth herein.

BACKGROUND

1. Field

Exemplary embodiments of the present disclosure relate to light source and display device technology.

2. Discussion

Examples of a flat panel display include a self-light emitting type display device emitting light by itself, such as a light emitting diode display (LED), an electric field emission display (FED), a vacuum fluorescent display (VFD), and a plasma display panel (PDP), and a light receiving type display device that does not emit light by itself but, instead, requires a light source, such as a liquid crystal display (LCD) and an electrophoretic display.

A display device including a separate light source among the light receiving type display devices may be a transmission type, and the transmission type display device includes a display panel displaying an image and a backlight unit supplying light to the display panel. The backlight unit includes a light source module emitting light, various optical sheets, and the like. The light source module may include at least one light source package, and each light source package may include a light source (also commonly referred to as a light emitting element). Examples of light sources include a cold cathode fluorescent lamp (CCFL), a flat fluorescent lamp (FFL), a light emitting diode (LED), and the like. Recently, a light emitting diode (LED) having small power consumption and small caloric value has been frequently used as a light source.

Accordingly, display technologies are typically configured so that light can be uniformly radiated on a rear surface of a display panel of the backlight unit, such that the backlight unit may be classified into a direct lighting type backlight unit, an edge type backlight unit, and the like, according to the position of the light source module. The direct lighting type backlight unit having a light source module will typically radiates light directly on the display panel, whereas the edge type backlight unit having a light source module will conventionally be provided on one side or both sides of a light guide so that light may be diffused through the light guide and, thereby, be indirectly radiated on the display panel.

The light source module of the backlight unit generally includes light source packages emitting lights of different colors in order to emit light of a white color, and light of the generated white color may be obtained by synthesizing lights of different colors emitted from each light source package. In this case, color stains may be formed on an image displayed on the display panel according to arrangement of the light source packages and the color of light emitted from the light source packages. For example, in the case where the color of the light source package corresponding to one edge of the display panel and the color of the light source package corresponding to another edge of the display panel are different from each other, the colors of both edges of the display panel may be differently viewed and, thereby, perceived as color stains.

Meanwhile, backlight units are typically divided into a plurality of light emitting blocks and the light emitting blocks are separately driven according to a driving method (or scheme) of the display device. For example, the backlight unit may be divided into a plurality of light emitting blocks and luminance of light emitted from each light emitting block may be controlled in order to prevent a contrast ratio of the display device from being reduced, as well as to minimize power consumption. This is generally referred to as a local dimming driving method. Further, in the case of three dimensional (3D) image display devices, when a display panel is divided into a plurality of display blocks and the display blocks are each sequentially driven, cross-talk phenomena, whereby a left eye image and a right eye image are perceived to overlap, may be prevented by dividing the backlight unit into a plurality of light emitting blocks corresponding to each display block and sequentially driving the display blocks to emit light.

The above information disclosed in this Background section is only for enhancement of understanding of the background of the invention and therefore it may contain information that does not form any part of the prior art nor what the prior art may suggest to a person of ordinary skill in the art.

SUMMARY

Exemplary embodiments provide a light source module that is capable of removing display defects, such as color stains, as well as improve color reproducibility and uniformity.

Exemplary embodiments provide a display device including a light source module that is capable of removing display defects, such as color stains, as well as improve color reproducibility and uniformity, such as when a backlight unit associated with the display device is divided into a plurality of light emitting blocks and the plurality of light emitting blocks are separately (or otherwise individually) driven.

Additional aspects of the invention will be set forth in the detailed description which follows and, in part, will be apparent from the disclosure, or may be learned by practice of the invention.

According to various exemplary embodiments, a light source module includes: two first light source packages configured to emit light of a first color; one or more second light source packages disposed between the two first light source packages, the one or more second light source packages being configured to emit light of the first color; and a plurality of third light source packages disposed between the two first light source packages and alternately arranged with the one or more second light source packages, the plurality of third light source packages being configured to emit light of a second color, wherein an intensity of light emitted from each of the one or more second light source packages is approximately twice an intensity of light emitted from each of the two first light source packages.

According to various exemplary embodiments, a display device includes: a display panel comprising a plurality of pixels configured to receive image data; and a backlight unit configured to radiate light towards the display panel, the backlight unit comprising a light source module, wherein the light source module comprises: two first light source packages configured to emit light of a first color, one or more second light source packages disposed between the two first light source packages, the one or more second light source packages being configured to emit light of the first color, and a plurality of third light source packages disposed between the two first light source packages and alternately arranged with the one or more second light source packages, the plurality of third light source packages being configured to emit light of a second color, and wherein an intensity of light emitted from each of the one or more second light source packages is approximately twice an intensity of light emitted from each of the two first light source packages.

According to the exemplary embodiments of the present invention, it is possible to remove display defects such as color stains of a display device and improve color s reproducibility. Further, it is easy to divide a backlight unit into a plurality of light emitting blocks and separately drive the light emitting blocks.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

FIG. 9 is a table for determining whether a plurality of channels may be constituted based on a number of light source packages provided in association with a light source module, according to an exemplary embodiment.

FIG. 11 is an illustrative table for determining whether a plurality of channels may be constituted based on the number of light source packages provided in association with the illustrative light source module of FIG. 10, according to an exemplary embodiment.

DETAILED DESCRIPTION OF THE ILLUSTRATED EMBODIMENTS

Figure 1:
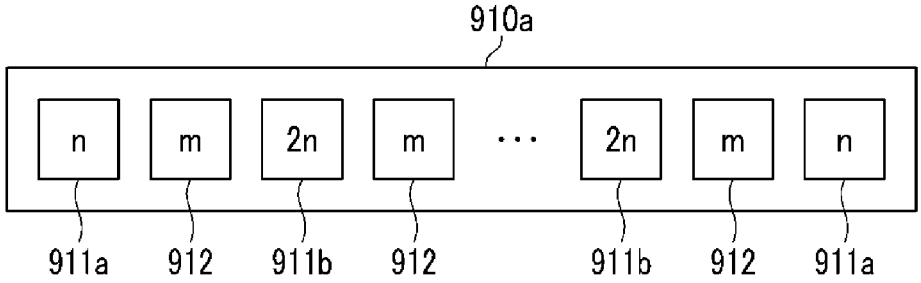
FIG. 1 is a schematic layout of a light source module, according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. It is further noted that features and functions associated with various exemplary embodiments may be combined, separated, and/or used as alternatives or additions as would be understood by one of ordinary skill in the art. In other instances, well-known structures and devices are shown in block diagram form in order to avoid unnecessarily obscuring various exemplary embodiments.

In the accompanying figures, the size and relative sizes of layers and/or regions may be exaggerated for clarity and descriptive purposes. Also, like reference numerals denote like elements.

When an element or layer is referred to as being "on" or "connected to" another element or layer, it may be directly on or directly connected to the other element or layer, or intervening elements or layers may be present. When, however, an element is referred to as being "directly on" or "directly connected to" another element or layer, there are no intervening elements or layers present. For the purposes of this disclosure, "at least one of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms first, second, third, etc., may be used herein to describe various elements, components, regions, layers and/or sections, these elements, components, regions, layers and/or sections should not be limited by the use of these terms. These terms are only used to distinguish one element, component, region, layer or section from another element, component, region, layer or section. Thus, a first element, component, region, layer or section that is discussed below could be termed a second, third, etc., element, component, region, layer or section without departing from the teachings of the present invention.

Spatially relative terms, such as "beneath", "below", "lower", "above", "upper" and the like, may be used herein for descriptive purposes and, thereby, to describe one element or feature's relationship to another element(s) or feature(s) as illustrated in the drawings. It will be understood that spatially relative terms are intended to encompass different orientations of an apparatus in use and/or operation in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations) and, as such, the spatially relative descriptors used herein are to be interpreted accordingly.

The terminology used herein is for the purpose of describing particular embodiments only and is not intended to be limiting. As used herein, the singular forms "a", "an" and "the" are intended to include the plural forms as well, unless the context clearly indicates otherwise. Moreover, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense unless expressly defined as such herein.

Figure 2:
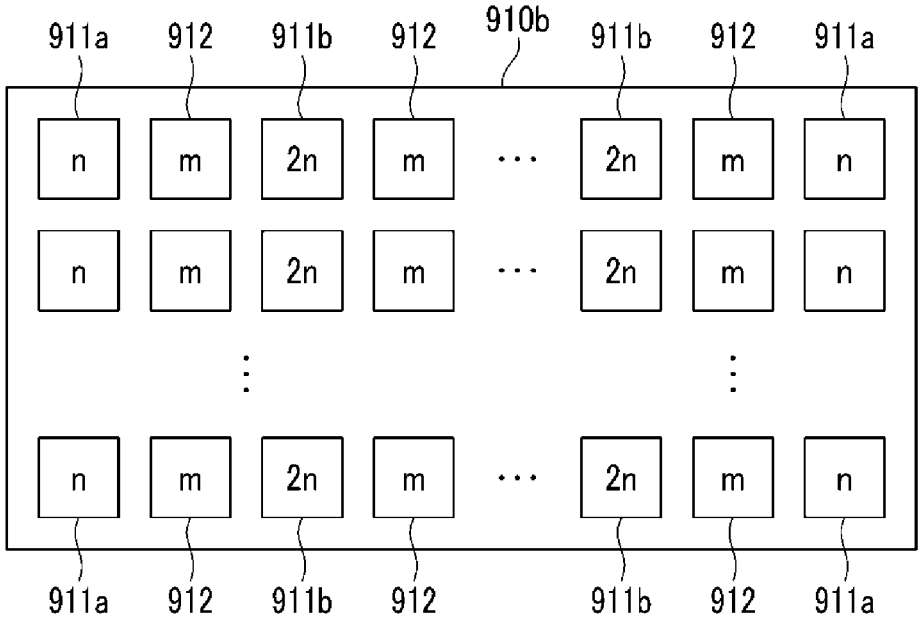
FIG. 2 is a schematic layout of a light source module, according to another exemplary embodiment.
Figure 3:
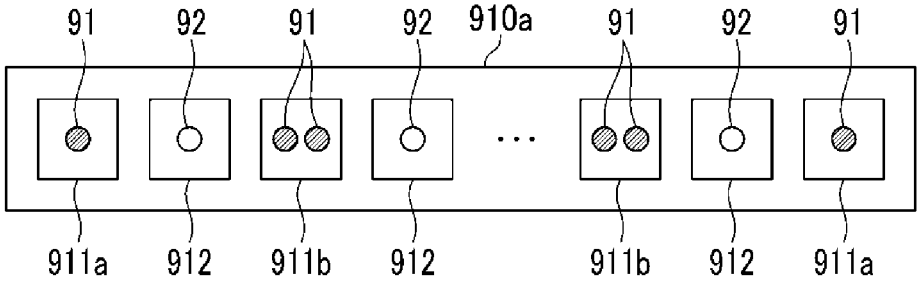
FIG. 3 is a schematic layout demonstrating disposition of exemplary light emitting elements included as part of corresponding light source packages of the light source module of FIG. 1, according to an exemplary embodiment.
Figure 4:
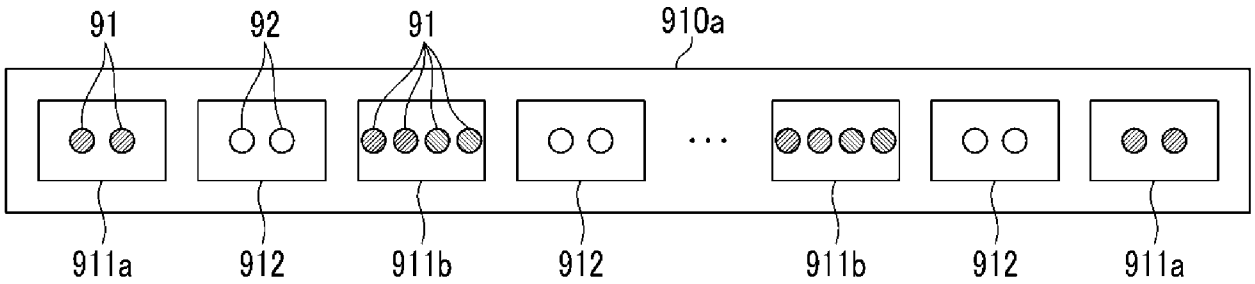
FIG. 4 is a schematic layout demonstrating disposition of exemplary light emitting elements included as part of corresponding light source packages of the light source module of FIG. 1, according to another exemplary embodiment.

FIGS. 1 and 2 are schematic layouts of illustrative light source modules, according to various exemplary embodiments. FIGS. 3 and 4 are schematic layouts demonstrating various dispositions of exemplary light emitting elements included as part of corresponding light source packages of the light source module of FIG. 1, according to various exemplary embodiments. It is noted that the dispositions (and/or other dispositions) may be provided in association with the light source module of FIG. 2.

As seen in FIGS. 1 and 2, light source modules 910*a* and 910*b* are configured as devices for emitting (or otherwise radiating) light. It is noted that light radiating from light source modules 910*a* and 910*b* may be directed to an external environment, which may include (or otherwise constitute) a display device, as will become more apparent below and in association with the description of FIGS. 12-16. According to various exemplary embodiments, light source modules 910*a* and 910*b* include at least two first light source packages 911*a* disposed at (or near) the corresponding lateral edges of light source modules 910*a* and 910*b*, at least one second light source package 911*b*, and one or more (e.g., a plurality) of third light source packages 912. While specific reference will be made to these particular implementations, it is also contemplated that one or both of light source modules 910*a* and 910*b* may embody many forms and include multiple and/or alternative components or features. For instance, light source modules 910*a* and/or 910*b* may include any suitable number of light source packages, as well as any suitable number of the aforementioned first, second, and third light source packages 911*a*, 911*b*, and 912. It is also contemplated that light source modules 910*a* and/or 910*b* may include any suitable number of additional (or alternative) light source packages, such as one or more fourth, fifth, etc., light source packages (not shown). It is noted, however, that as depicted, FIG. 1 illustrates an exemplary edge type light source module 910*a*, whereas FIG. 2 illustrates an exemplary direct lighting type light source module 910*b*, according to various exemplary embodiments.

Light source packages 911*a*, 911*b*, and 912 may include at least one light emitting element; however, any suitable number of light emitting elements may be provided, as will become more apparent below. Exemplary light emitting elements may include a light emitting diode (LED) chip, but are not limited thereto.

Adverting momentarily to FIG. 1, exemplary edge type light source module 910*a* comprises two first light source packages 911*a*, at least one second light source package 911*b*, and a plurality of third light source packages 912, which may be arranged (or otherwise disposed) in a row to form a linear (or substantially linear) light source. First light source packages 911*a* may be positioned at the lateral edges of the light source module 910*a*, whereas at least one second light source package 911*b* and a plurality of third light source packages 912 may be alternately disposed between the first light source packages 911*a* disposed at the corresponding lateral edges of light source module 910*a*.

Referring to FIG. 2, exemplary direct lighting type light source module 910*b* comprises two first light source packages 911*a*, at least one second light source package 911*b*, and a plurality of third light source packages 912, which may be arranged (or otherwise disposed) in a matrix (or any other suitable formation) to form a planar (or substantially planar) light source. Light source packages 911*a*, 911*b*, and 912 included as part of each row of the light source package matrix illustrated in FIG. 2 may have the same arrangement as the light source packages 911*a*, 911*b*, and 912 included as part of the edge type light source module 910*a* illustrated in FIG. 1. However, the light source packages 911*a*, 911*b*, and 912 included in the direct lighting type light source module 910*b* may be arranged in a manner different from that depicted in FIG. 2. In other words, any suitable number and/or arrangement of light source packages may be provided in association with light source module 910*a* and/or 910*b*. For example, light source packages at (or near) an outer periphery of light source module 910*b* may be the same, such as each one corresponding to light source package 911*a*, such that each interior row and column of the light source package matrix is configured to correspond to the arrangement of light source packages 911*a*, 911*b*, and 912 illustrated in association with FIG. 1. Again, any other suitable configuration and/or arrangement are contemplated.

With continued reference to FIGS. 1 and 2, the first light source package 911*a* and the second light source package 911*b* may be configured to emit light of the same first color, and the third light source package 912 may be configured to emit light of a second color that is different from the first color. For example, the first and second light source packages 911*a* and 911*b* may be configured to emit light of a magenta (or substantially magenta) color, such as in association with the mixing of blue and red (or substantially blue and red) colors, and the third light source package 912 may be configured to emit light of a green (or substantially green) color. It is contemplated, however, that any number and/or range of colors may be provided in association with light source packages of a light source module.

Light emitted from the first light source package 911*a* and the third light source package 912 that are adjacent to each other or the second light source package 911*b* and the third light source package 912 that are adjacent to each other may be mixed with one another, such that the light of the mixed color(s) may be emitted from the light source module 910*a* or 910*b*. According to one exemplary embodiment, light of one or more mixed colors may be light of a white (or substantially white) color.

According to various exemplary embodiments, luminance (or intensity) of light emitted from the first light source package 911*a* may be approximately half of the luminance of light emitted from the second light source package 911*b*. For example, the luminance of light emitted from each second light source package 911*b* may be approximately two times the luminance or intensity of light emitted from each first light source package 911*a*. It is contemplated, however, that any other suitable ratio of intensities may be provided, as well as established between any at least two light source packages.

In certain exemplary embodiments, the intensity of light emitted from the third light source package 912 may be approximately the same as the intensity of light emitted from the second light source package 911*b*. However, the intensity of light emitted from the third light source package 912 may be different from the intensity of light emitted from the second light source package 911*b*, such as, in accordance with the sensitivity of the color of light emitted from the third light source package 912.

As an example, the intensity of light emitted from the first light source package 911*a* may be set to approximately half the intensity of light emitted from the second light source package 911*b* by including n (where n is a natural number of 1 or more) number of light emitting elements as part of the first light source package 911*a* and 2*n* number of light emitting elements as part of the second light source package 911*b*. As such, when the light emitting elements included as part of the first and second light source packages 911*a* and 911*b* emit light having the same luminance, the intensity of light emitted from the first light source package 911*a* may be approximately half the intensity of light emitted from the second light source package 911*b*. As previously mentioned, it is contemplated that the ratio of intensities between light source packages may be set to any suitable value. It is also contemplated that any other suitable method to control the respective intensities of light source packages may be implemented, such as by controlling the respective power supplied to respective light source packages, utilizing different types of light source packages, etc.

In continuation of the above-noted example, the number m (where m is a natural number of 1 or more) of the light emitting elements included as part of the third light source package 912 may be configured to depend on the luminance of light emitted from one or more of the other light emitting elements, but may be suitably controlled so that light of a desired color (e.g., light of a white color) may be obtained in association with the mixing of colors of lights emitted from the second light source package(s) 911*b* and the third light source package 912 that are disposed adjacent to one another or from the first light source package(s) 911*a* and the third light source package 912 that are disposed adjacent to one another.

Adverting to FIG. 3, an exemplary disposition of light emitting elements is shown in association with light source module 910*a* of FIG. 1. As shown, the first light source packages 911*a* include one first light emitting element 91, the second light source packages 911*b* include two first light emitting elements 91, and the third light source package 912 includes one second light emitting element 92.

As seen in FIG. 4, i.e., another exemplary disposition of light emitting elements provided in association with light source module 910*a* of FIG. 1, the first light source packages 911*a* include two first light emitting elements 91, the second light source packages 911*b* include four first light emitting elements 91, and the third light source packages 912 include two second light emitting elements 92.

According to various exemplary embodiments, corresponding light emitting elements, such as corresponding light emitting elements 91 and 92, may be configured differently from one another, such as to emit different colors of light. For example, one light emitting element 91 may be configured to emit a different color than another light emitting element 91; however, each of these light emitting elements 91 may be considered a first type of light emitting element. The same may be true with respect to light emitting elements 92; however, light emitting elements 92 may be considered a second type of light emitting element. It is also contemplated that one or more other (or additional) types and/or configurations between corresponding light emitting elements may be provided. For instance, a light source package may include a combination of different types of light emitting elements, such as a combination between one or more first light emitting elements 91 and one or more second light emitting elements 92.

According to various exemplary embodiments, such as illustrated in FIGS. 3 and 4, a color of light emitted from a first light emitting element 91 may be different from a color of light emitted from the first light source package 911*a* itself, and a color of light emitted from the second light emitting element 92 may be the same as a color of light emitted from the third light source package 912 itself. In this manner, a color of light emitted from first light emitting element 91 may be referred to as a third color. In continuation of the above-noted example, first and second light source packages 911*a* and 911*b* may be configured to emit light of a magenta (or substantially magenta) color that is obtained via mixing one or more other colors. As such, one or more light emitting elements 91 of first and second light source packages 911*a* and 911*b* may be configured to emit a blue (or substantially blue) color and one or more other light emitting elements 91 of first and second light source packages 911*a* and 911*b* may be configured to emit a red (or substantially red) color. In this manner, the mixing of the colors associated with these light emitting elements 91 may be configured to produce the aforementioned magenta (or substantially magenta) color. Further, third light emitting package 912 may be configured to emit light of a green (or substantially green) color, such that one or more light emitting elements 92 may be configured to emit the green (or substantially green) color.

It is also contemplated that that the luminance (or intensity) of respective light emitting elements (e.g., light emitting elements 91 and 92) may be controlled to produce one or more variably controlled colors associated with corresponding light source packages, such as light source packages 911*a*, 911*b*, and 912. For example, the magenta (or substantially magenta) color associated with first light source package 911*a* may be variably controlled by controlling the respective blue (or substantially blue) and/or red (or substantially red) colors of one or more of light emitting elements 91 associated with first light source package 911*a*. In this manner, one or more hues of a same or different color may be emitted.

As described above, the luminance of light emitted from the lateral edge(s) and middle portion(s) of light source modules 910*a* and/or 910*b* may be substantially the same by setting (or otherwise controlling) the intensity of light emitted from the first light source package 911*a* disposed at (or near) the lateral edge of light source modules 910*a* and 910*b* to approximately half the intensity of light emitted from the second light source package 911*b* or the third light source package 912. In cases where the intensity of emitted light depends on a position within light source modules 910*a* and/or 910*b*, visible color stains may be prevented. It is noted that the position may be establish in association with one or more imaginary axes, e.g., along an imaginary axis, within a plane defined by two imaginary axes, etc.

It is also noted that while the intensity of light emitted from, for instance, the first light source packages 911*a* positioned at (or near) corresponding lateral edges of the light source module 910*a* or 910*b* is approximately half the intensity of light emitted from the light source package(s) positioned at a middle portion of the light source module 910*a* or 910*b*, the degree of contribution to the overall luminance of the light of a white color may be configured to depend on a kind of the color of light emitted from any given light source package. Accordingly, in instances where light source packages emitting light of various different colors are disposed at (or near) corresponding lateral edges of a light source module, color stains may be visible at (or near) such corresponding lateral edges of the light source module. Exemplary embodiments, however, prevent such color stains by disposing first light source packages 911*a*, which are configured to emit light of the same color at the corresponding lateral edges of the light source modules 910*a* and 910*b*.

Figure 5:
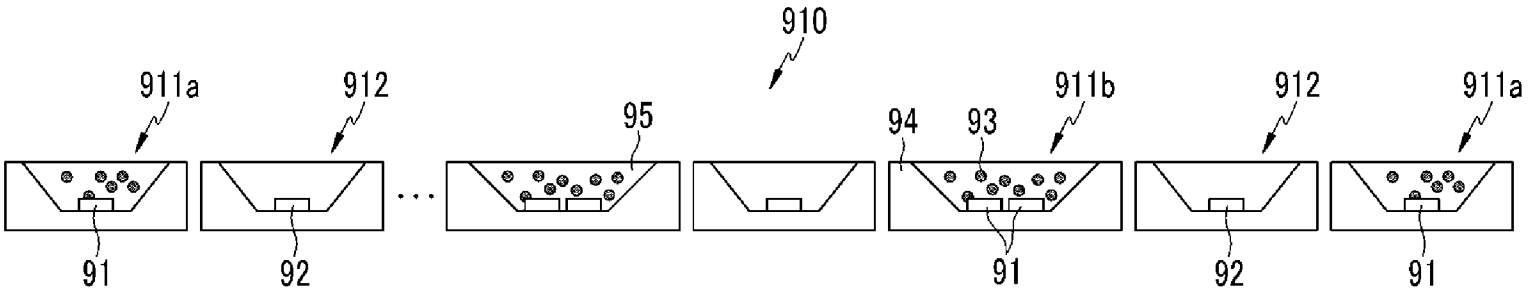
FIG. 5 is a cross-sectional view of a light source package configured in association with a light source module, according to an exemplary embodiment.

FIG. 5 is a cross-sectional view of a light source package configured in association with a light source module, according to an exemplary embodiment.

As seen in FIG. 5, and with continued reference to FIGS. 1-4, the first light source package 911*a* and the second light source package 911*b* may, according to certain exemplary s embodiments, include the first light emitting element 91, which is configured to emit light of a third color, and the fluorescent body 93 configured to emit light of a fourth color, respectively.

According to various exemplary embodiments, the fluorescent body 93 may be disposed around the first light emitting element 91. The fluorescent body 93 may include at least one fluorescent body selected as a silicate-based fluorescent body, including, for example, a $Zn_2SiO_4:Mn^{2+}$ fluorescent body, a $Mg_2SiO_4:Mn^{2+}$ fluorescent body, a $Ba_2SiO_4:Mn^{2+}$ fluorescent body, a $Sr_2SiO_4:Mn^{2+}$ fluorescent body, a $Ca_2SiO_4:Mn^{2+}$ fluorescent body, and/or the like, as well as combinations thereof. The fluorescent body 93 may be excited by a portion of light emitted from the first light emitting element 91, and the excited fluorescent body 93 may be stabilized to emit light of a fourth color. Accordingly, the first light source package 911*a* and the second light source package 911*b* may be configured to emit light of both the fourth color, which has been emitted from the fluorescent body 93, and light of the third color, which has been emitted from the first light emitting element 91. In various exemplary embodiments, the first color of light emitted from the first light source package 911*a* and the second light source package 911*b* may be a mixed color resulting from the mixing of the fourth color of light emitted from the fluorescent body 93 and the third color of light emitted from the first light emitting element 91. In one illustrative embodiment, the third color may be a blue color and the fourth color may be a red, such that the first color may be magenta color resulting from the mixture between the blue and red colors.

According to various exemplary embodiments, the intensity of light emitted from the fluorescent body 93 may be dependent upon the intensity of light emitted from the first light emitting element 91. In this manner, the intensity of light emitted from the fluorescent body 93 may be controlled by controlling the intensity of light emitted from the first light emitting element 91.

The third light source package 912 includes the second light emitting element 92 emitting light of the second color. As previously mentioned, the second color may be a green color. While not illustrated, it is also contemplated that third light source package 912 may include one or more fluorescent bodies. In this manner, the second color may be the result of the mixing of colors emitted from second light emitting element 92 and the one or more other fluorescent bodies, or the third color may alternatively be provided as two or more colors.

According to one exemplary embodiment, the third color may be a blue color, the fourth color may be a red color, and the second color may be a green color. In this manner, light of the green color may contribute to the luminance of a resulting white color generated from the second light emitting element 92 of the independent third light source package 912 and, as such, a sufficient intensity of light corresponding to the green color may be obtained. Further, a wide color space may be ensured on a color coordinate, such that high color reproducibility and excellent color uniformity may be obtained.

Conventionally, and unlike the disclosed exemplary embodiments, in instances where the light emitting element is configured to emit light of the red color is separately used, if a large change in the intensity of light of the red light emitting element is effectuated according to a change in temperature, a large color deviation according to the change in temperature can occur. According to various exemplary embodiments, however, since the first and second light source packages 911*a* and 911*b*, which comprise the first light emitting element 91, that is configured to emit light of a blue color, and the fluorescent body 93, that is configured to emit light of a red color, emit light together, the intensity of light of a red color can be controlled in dependence on the intensity of light of the blue color, such that a deviation of one or more characteristics of light of the red color, light of the green color, and/or light of the blue color based on a change in a circumferential temperature can be controlled and reduced.

With continued reference to FIG. 5, each light source package 911*a*, 911*b*, and 912 may further include a buffer layer 95 disposed on the light emitting elements 91 and 92 to encapsulate the light emitting elements 91 and 92. It is noted that the buffer layer 95 may be referred to as a packaging portion, and may be manufactured from one or more transparent resins, such as one or more epoxy resins, silicon resins, etc., and/or combinations thereof, such as in a hybrid resin. As such, the fluorescent body 93 of the first and second light source packages 911*a* and 911*b* may, in various exemplary embodiments, be dispersed in the buffer layer 95. Additionally (or alternatively), the fluorescent body 93 may be applied as, for example, a fluorescent body thin-film disposed along the surface of the first light emitting element 91 and/or disposed on the surface of the buffer layer 95.

The first light emitting element 91 and the second light emitting element 92 of each light source package 911*a*, 911*b*, and 912 may be disposed on (or in association with) a packaging mold 94 comprising a reflection cup. In one exemplary embodiment, the reflection cup may be configured to house (or at least partially support) one or more light emitting elements (e.g., one or more of light emitting elements 91 and/or 92), buffer layer 95, and/or one or more fluorescent bodies 93. As such, an upper surface of the buffer layer 95 may be flat (or substantially flat). It is contemplated, however, that the upper surface may be additionally and/or alternatively configured, such as to embody one or more parabolic and/or other geometric configuration(s). For instance, one or more lenticulated lens surfaces, one or more Fresnel lens surfaces, one or more gradient-index lens surfaces, and/or the like lens surfaces, may be formed in association with the upper surface if buffer layer 95. In this manner, the upper surface may be s configured as a lens surface to direct or otherwise affect the propagation of light emitted from corresponding elements of light source packages 911*a*, 911*b*, and 912.

While not illustrated, the first light emitting element 91 and the second light emitting element 92 may be mounted on one or more other surfaces and/or components, such as on a circuit board (not shown), e.g., a printed circuit board (PCB), or one or more conducting materials. In this manner, the lens effects of one or more of light source packages 911*a*, 911*b*, and 912 may be controlled via one or more components connected to (or in communication with) the circuit board or conducting material(s).

According to various exemplary embodiments, light source modules may be driven in association with a plurality of channels, which will become more apparent below in association FIGS. 6-8.

Figure 6:
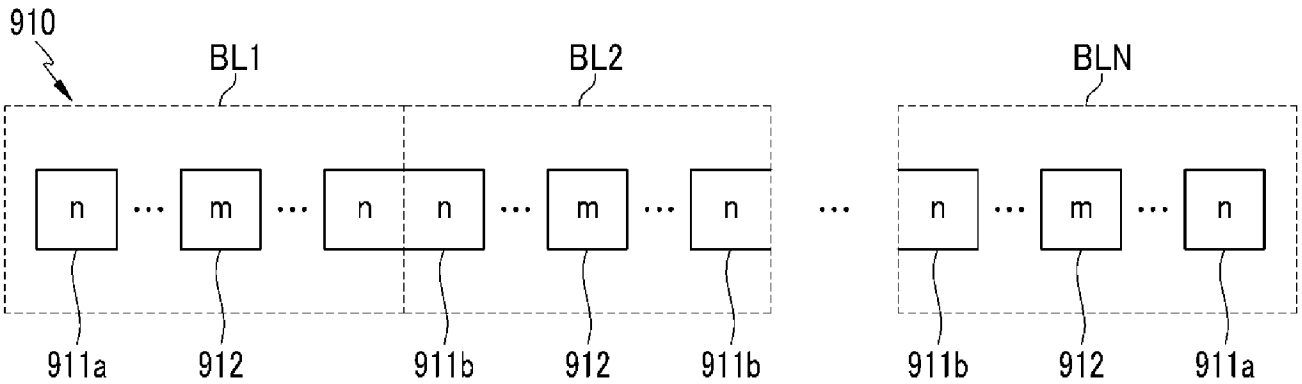
FIG. 6 is a schematic layout illustrating a method of dividing a light source module in association with a plurality of channels, according to an exemplary embodiment.
Figure 7:
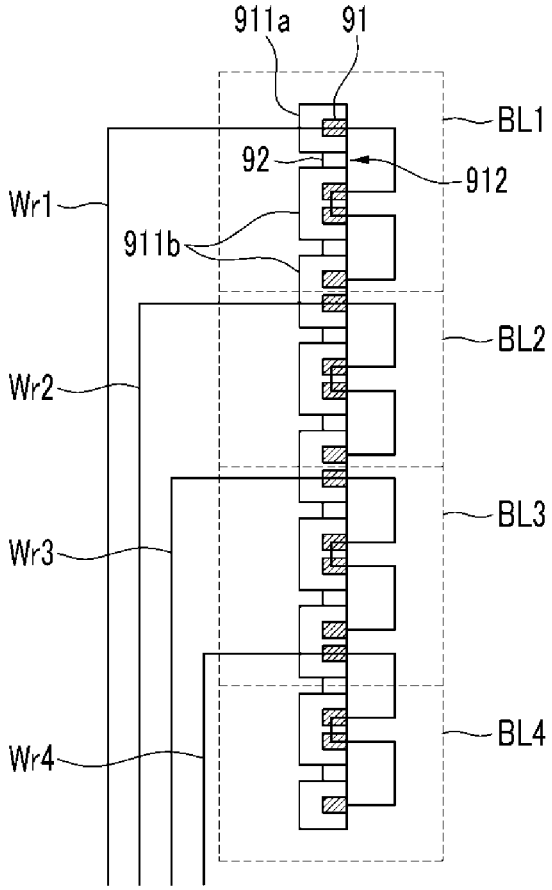
FIG. 7 is a schematic layout illustrating a method of dividing a light source module in association with a plurality of channels, according to another exemplary embodiment.
Figure 8:
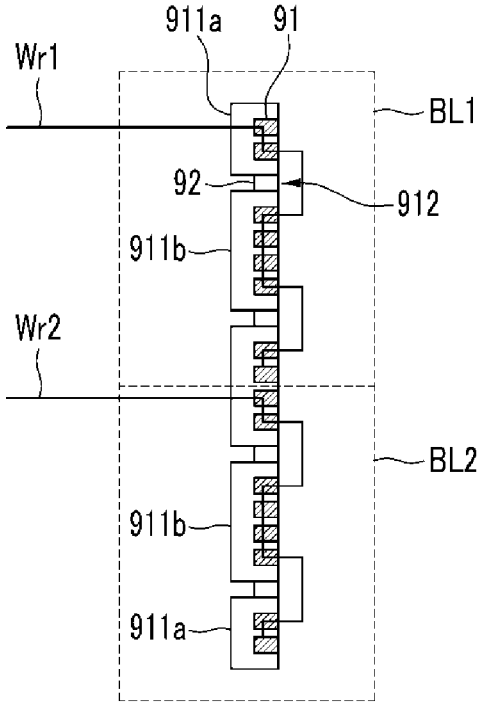
FIG. 8 is a schematic layout illustrating a method of dividing a light source module in association with a plurality of channels, according to yet another exemplary embodiment.

FIGS. 6-8 are schematic layouts illustrating methods of dividing a light source module in association with a plurality of channels, according to various exemplary embodiments. In the proceeding description, one or more exemplary light source modules are collectively referred to as light source module 910. As such, it is contemplated that one or more of the driving schemes described below may be applied in association with light source modules 910*a* and/or 910*b* and/or applied in association with other alternatively configured light source modules.

As seen in FIG. 6, the light source module 910, according to one exemplary embodiment, is configured relatively similar to that of light source module 910*a* illustrated in FIG. 1. In this manner, light source module 910 may be divided into a plurality of light emitting blocks BL1, BL2, . . . , and BLN (where N is a natural number), which may be independently driven to emit light.

Each light emitting block BL1, BL2, . . . , and BLN includes a number 2nk of first light emitting elements 91 (where n and k are natural numbers of 1 or more) and a number k of third light source packages 912. Further, and as illustrated in each of FIGS. 6-8, a first half and a second (or residual) half of those light emitting elements included as part of the second light source package 911*b* may be configured in different light emitting blocks BL1, BL2, . . . , and BLN that are disposed adjacent to each other. In other words, those light source packages illustrated in FIGS. 1 and 2 comprising 2*n* light emitting elements may have one or more of those light emitting elements separated into a different light emitting block than one or more other ones of those light emitting elements.

The first light emitting elements 91 corresponding to the number n included in the first light source package 911*a* or the second light source package 911*b* may be positioned at (or near) corresponding lateral edges of each light emitting block BL1, BL2, . . . , and BLN, and at least one third light source package 912 may be positioned therebetween. At least one second light source package 911*b* may be further included in at least one middle portion of one or more of light emitting blocks BL1, BL2, . . . , and BLN.

According to one exemplary embodiment, each of the two light emitting blocks BL1 and BLN disposed at (or near) either lateral edge of the light source module 910 may be configured to include a first light source package 911*a*, a half of the first light emitting elements 91 disposed closer to the first light source package 911*a* and are associated with a second light source package 911*b*, and at least one third light source package 912 positioned in a middle portion thereof. While note illustrated, it is noted that each of light emitting blocks BL1 and BLN positioned at (or near) a lateral edge of the light source module 910 may further include at least one second light source package 911*b* positioned between adjacent third light source packages 912.

In this manner, respective halves of the above-noted second light source package 911*b* may be disposed at (or near) corresponding edges of the light emitting blocks BL2, . . . , and BL N−1 disposed between light emitting blocks BL1 and BLN. Further, at least one third light source package 912 may be positioned at a middle portion of each of light emitting blocks BL2, . . . , and BL N−1. Again, while not illustrated, each light emitting block BL2, . . . , and BL N−1 may further include at least one second light source package 911*b* positioned between the adjacent third light source packages 912.

Adverting to FIG. 7, an exemplary light source module is depicted including four light emitting blocks BL1, BL2, BL3, and BL4. Further, the exemplary light source module of FIG. 7 comprises the first light source package 911*a* having one first light emitting element 91, the second light source package 911*b* having two first light emitting elements 91, and the third light source package 912 having one second light emitting element 92. While specific reference will be made hereto, it is contemplated that the light source module may be alternatively configured.

According to the exemplary embodiment illustrated in FIG. 7, the light emitting blocks BL1 and BL4 disposed at (or near) the edge of the light source module each comprise a first light emitting element 91 of one first light source package 911*a*, one first light emitting element 91 included in a second light source package 911*b* positioned at one edge of the light emitting blocks BL1 and BL4, two first light emitting elements 91 included in a second light source package 911*b* positioned at a middle portion of light emitting blocks BL1 and BL4, and a second light emitting element 92 included in two third light source packages 912.

The light emitting blocks BL2 and BL3 disposed in a middle portion of the light source module illustrated in FIG. 7, each include one first light emitting element 91 included in one second light source package 911*b*, one first light emitting element 91 included in another second light source package 911*b*, two first light emitting elements 91 included in a second light source package 911*b* positioned at a middle portion of light emitting blocks BL2 and BL3, and a second light emitting element 92 of two third light source packages 912.

As seen in FIG. 8, there is depicted an exemplary light source module including two light emitting blocks BL1 and BL2. Further, the exemplary light source module of FIG. 8 comprises the first light source package 911*a* having two first light emitting elements 91, a second light source package 911*b* having four first light emitting elements 91, and a third light source package 912 having two second light emitting elements 92.

With continued reference to FIGS. 6-8, the first light emitting elements 91 of the first light source packages 911*a* or the second light source packages 911*b* included in each of light emitting blocks BL1, BL2, . . . , and BLN may be connected to each other in series via wires Wr1, Wr2, Wr3, and Wr4 to form one or more individual channels, and the second light emitting elements 92 of the third light source packages 912 may be connected to each other in series to form one or more individual channels.

According to certain exemplary embodiments, at least one of the number of channels formed by the first light emitting elements 91 of one light emitting block BL1, BL2, . . . , and BLN and the number of channels formed by the second light emitting element 92 may be two or more, and the number of channels formed by the first light emitting elements 91 and the number of channels formed by the second light emitting elements 92 may have a divisor/multiple relationship. In a case where all of the first light emitting elements 91 or the second light emitting elements 92 included in each light emitting block BL1, BL2, . . . , and BLN form a plurality of channels, the first light emitting elements 91 or the second light emitting elements 92 of a plurality of channels included in one light emitting block BL1, BL2, . . . , and BLN may be driven together.

Accordingly, in one light source module, the number of channels of the first and second light source package 911*a* and

911*b* that are configured to emit light of the first color and the number of channels of the third light source packages 912 that are configured to emit light of the second color may be the same as each other or have a divisor or multiple relationship. In a case where the number of channels of the first and second light source packages 911*a* and 911*b* and the number of channels of the third light source packages 912 are the same as each other with respect to one light source module, the channels of the first and second light source packages 911*a* and 911*b* and the channels of the third light source packages 912, which correspond to each other, may together form one light emitting block BL1, BL2, . . . , and BLN, and each light emitting block BL1, BL2, . . . , and BLN may emit light of the white color. The intensities of light emitted from the first light emitting element 91 and the second light emitting element 92 may be controlled by separately inputting a driving current to the first light emitting element 91 and the second light emitting element 92 in order to emit light of the white color.

As described above, since one light source module may be divided into a plurality of light emitting blocks BL1, . . . , BLN, each of which emit light of the white color, each light emitting block BL1, . . . , and BLN may be independently driven.

Accordingly, it is noted that the number of channels or the number of light emitting blocks BL1, . . . , and BLN included in a given light source module may be appropriately set and, as such, the degree of freedom to select the number of channels or the number of light emitting blocks BL1, . . . , and BLN is large. As such, reference tables may be utilized to determine if a plurality of channels may be constituted, which will become more apparent below in association with FIGS. 9-11.

Figure 10:
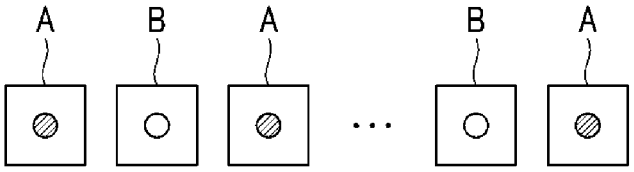
FIG. 10 is a schematic layout of an illustrative light source module, according to an exemplary embodiment.

FIG. 9 is a table for determining whether a plurality of channels may be constituted based on a number of light source packages provided in association with a light source module, according to an exemplary embodiment. FIG. 10 is a schematic layout of an illustrative light source module, according to an exemplary embodiment. FIG. 11 is an illustrative table for determining whether a plurality of channels may be constituted based on the number of light source packages provided in association with the illustrative light source module of FIG. 10.

First, and with reference to the table of FIG. 9, the aggregate number of the first and second light source packages 911*a* and 911*b* configured to emit light of the first color is enumerated in a row of a first column, whereas the total number of the first light emitting elements 91 included in the aggregate number of first and second light source packages 911*a* and 911*b* is enumerated in the row of a second column. Further, the aggregate number of the third light source packages 912 is enumerated in the row of a third column. As such, the illustrated exemplary embodiment of FIG. 9 demonstrates an example where the second light source package 911*b* includes two first light emitting elements 91, but as described above, exemplary embodiments are not limited thereto.

According to various exemplary embodiments, since a light source module may be configured to comprise the first light source packages 911*a* at (or near) corresponding lateral edges of the light source module, the number of the first and the second light source packages 911*a* and 911*b* will be more than that of the third light source package 912 by one package. However, since the number of first light emitting elements 91 included in a first light source package 911*a* is half the number of first light emitting elements 91 included in a second light source package 911*b*, the total number of first light emitting elements included in the light source module may be a multiple of the number of third light source packages 912. As seen in FIG. 9, since the second light source package 911*b* includes two first light emitting elements 91, the total number of first light emitting elements 91 is two times the number of third light source packages 912.

Accordingly, determining whether a plurality of channels may be formed can be assessed based on whether the number of third light source packages 912 is a prime number. As seen in FIG. 9, in those cases where the number of third light source packages 912 is a prime number (e.g., 23, 29, 37, or 41), a plurality of channels cannot be constituted. As such, when a calculation is performed for those cases where the number of first and second light source packages 911*a* and 911*b* is limited to 23 or more and 42 or less, it can be expected that a probability of constituting a plurality of channels is approximately 15/20.

A comparative example is described in association with FIGS. 10 and 11.

If a light source module is alternately arranged as illustrated in FIG. 10, and are configured to include a first type light source package "A" and a second type light source package "B", each of which is configured to emit light of a different color is provided, and the first type light source packages "A" are configured to emit light of the same color are arranged at (or near) the lateral edges of the light source module, then as illustrated in FIG. 11, the number of first type light source packages "A" will be more than the number of second type light source packages "B" by one package.

Further, and as illustrated in FIG. 11, whether both the number of first type light source packages "A" and the number of second type light source packages "B" are prime numbers or not may be determined in order to further determine whether a channel may be constituted or not. That is, neither the number of first type light source packages "A" nor the number of second type light source packages "B" should be prime numbers, but instead, should be non-prime natural numbers in order to constitute a plurality of channels. Accordingly, when a calculation is performed for those cases where the number of first type light source packages "A" is limited to 23 or more and 42 or less, it can be expected that a probability of constituting a plurality of channels is approximately 10/20. This probability is even lower than the probability of constitution of the channels according to the aforementioned exemplary embodiment illustrated in FIG. 9. In addition, and in association with the exemplary embodiment illustrated in FIGS. 10 and 11, the number of channels formed of the first type light source packages "A" cannot be set to the number of channels formed of the second type light source packages "B" and, as such, the light source module cannot be divided into a plurality of light emitting blocks configured to emit light of the white color.

According to various exemplary embodiments, a display device may be configured with one or more edge type light source modules, as will become more apparent below in association with FIGS. 12-14.

Figure 12:
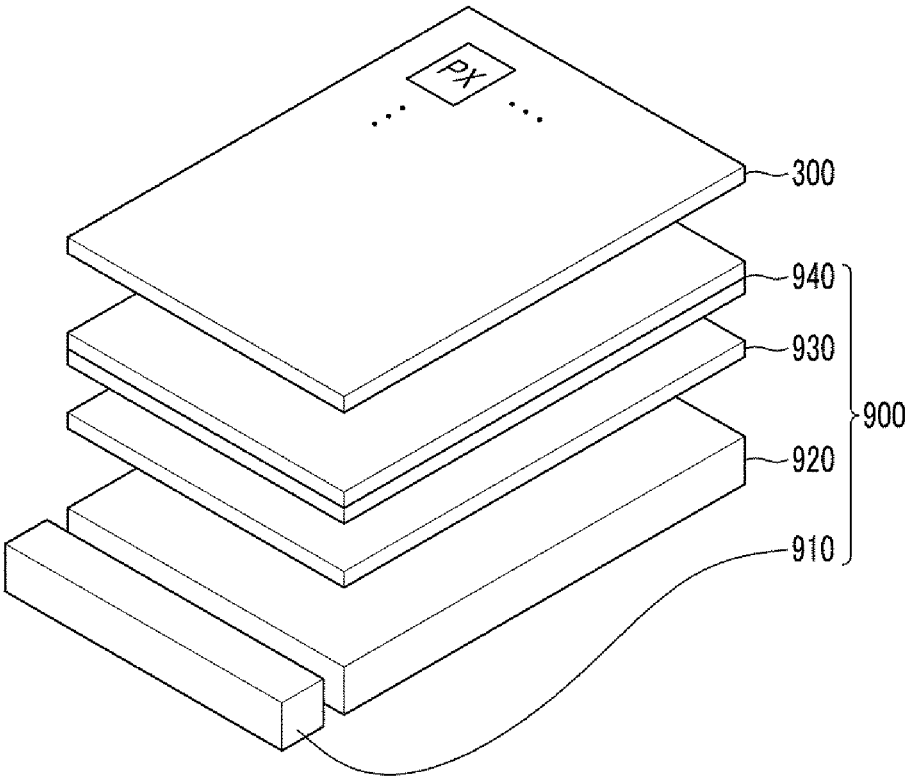
FIG. 12 is a schematic exploded perspective view of a display device, according to an exemplary embodiment.

FIG. 12 is a schematic exploded perspective view of a display device, according to an exemplary embodiment. FIG. 13 is a plan view illustrating a constitution of a backlight unit, according to an exemplary embodiment. FIG. 14 is a schematic exploded perspective view of a display device, according to another exemplary embodiment.

As seen in FIG. 12, the display device may be configured to include a display panel 300 and a backlight unit 900, the display panel 300 being disposed on a surface of the backlight unit 900.

The display panel 300 may include a plurality of pixels (PX) and a panel driving portion (not shown) to configured to apply (or otherwise impose) a driving signal to (or on) the pixels.

The backlight unit 900 may include the light source module 910 and the light guide 920, and may further include at least one of a diffuser 930 and an optical sheet 940.

In this exemplary embodiment, light source module 910 is configured as an edge type light source module and, as such, may be configured in accordance with light source module 910*a*. For the sake of brevity, a detailed description of light source module 910 will be omitted. It is noted, however, that the light source module 910 may be disposed adjacent to a lateral surface of the light guide 920.

The light guide 920 may be configured to guide light emitted from the light source module 910 to the display panel 300.

Figure 13:
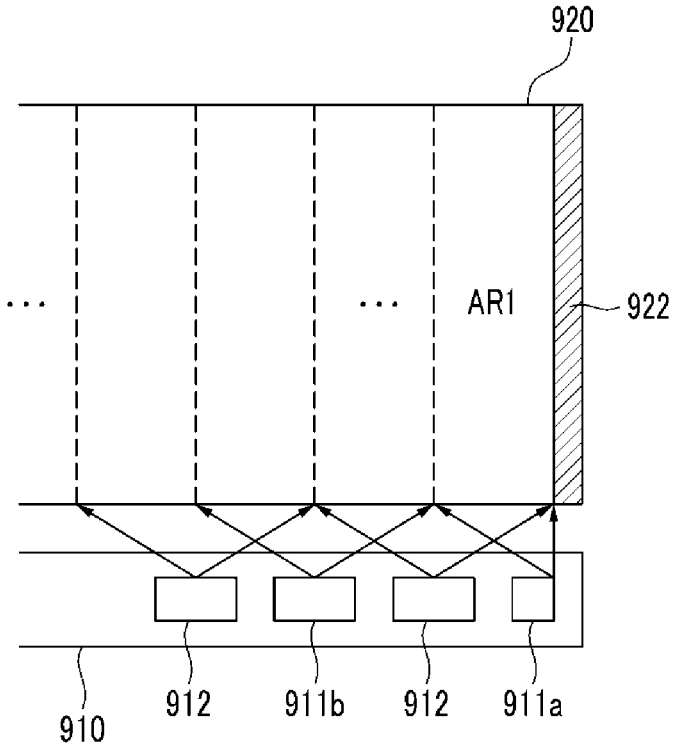
FIG. 13 is a plan view illustrating a constitution of a backlight unit, according to an exemplary embodiment.
Figure 14:
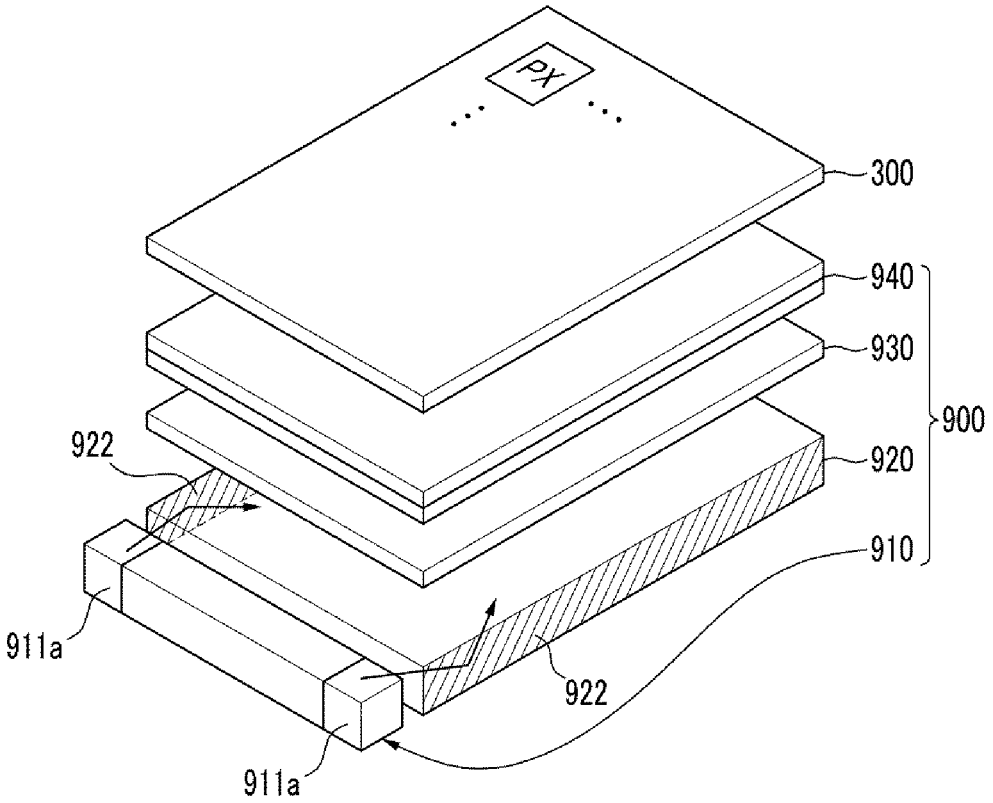
FIG. 14 is a schematic exploded perspective view of a display device, according to another exemplary embodiment.

Adverting to FIGS. 13 and 14, the edge surface corresponding to the first light source package 911*a* positioned at (or near) the lateral edge of the light source module 910 among the edges of the light guide 920, according to various exemplary embodiments, may include a mirrored surface (or reflection surface) 922. Accordingly, light of the first color emitted from the first light source package 911*a* at (or near) the lateral edge of the light source module 910 may be received by the light guide 920 and, thereby, reflected on the mirrored surface 922 without a substantial loss of intensity, and thus, being focused in the first region AR1 of the light guide 920. Accordingly, colors of light reaching the first region AR1 and light of the first color emitted from the first light source package 911*a* among light of the second color emitted from the third light source package 912 that is disposed adjacent to the first light source package 911*a* may be mixed to generate and move light of the white color having high color reproducibility and color uniformity to the display panel 300.

Referring back to FIG. 12, the diffuser 930 may be positioned on the upper portion of the light guide 920 and may be configured to uniformly diffuse light emitted from the light guide 920 and, thereby, configured to improve uniformity of luminance of light propagating towards display panel 300. That is, the diffuser 930 may disperse light that is incident from the light guide 920 to prevent light from being locally focused.

The optical sheet 940 may include at least one optical sheet, such as a prism sheet, and, thereby, configured to improve luminance and uniformity, and/or one or more other light characteristics of light propagating towards display panel 300 from light source module 910.

According to various exemplary embodiments, a display panel may be configured with one or more direct lighting type light source modules, as will become more apparent below in association with FIG. 15.

Figure 15:
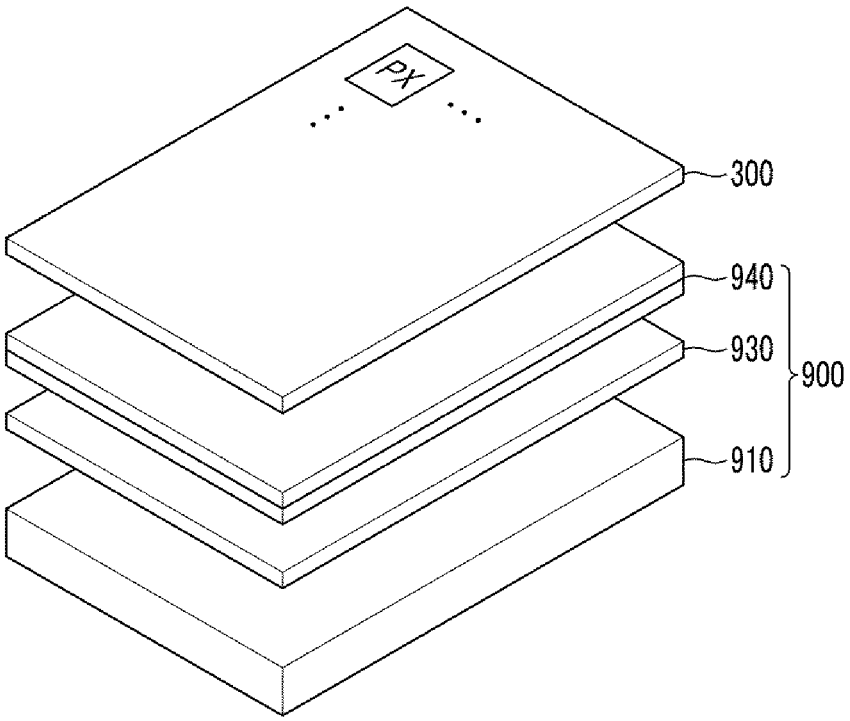
FIG. 15 is a schematic exploded perspective view of a display device, according to yet another exemplary embodiment.

FIG. 15 is a schematic exploded perspective view of a display device, according to yet another exemplary embodiment.

The display device of FIG. 15 is similar to the display device of FIG. 12; however, the light source module 910 of FIG. 15 may be configured differently than as configured in FIG. 12. In this manner, the light guide 920 may not be included.

In this exemplary embodiment, light source module 910 is configured as a direct lighting type light source module and, as such, may be configured in accordance with light source module 910*b*. Thus, for the sake of brevity, a detailed description of light source module 910 will be omitted. It is noted, however, that the direct lighting type light source module 910 may directly emit light to the display panel 300.

According to various exemplary embodiments, however, the diffuser 930 may be disposed on the light source module 910, and may be configured to receive light emitted from the light source module 910. In this manner, diffuser 930 may be further configured to emit light having improved luminance and uniformity to the display panel 300. Since other various characteristics of the diffuser 930 and the optical sheet 940 are the same as those of the aforementioned display device of FIG. 12, a detailed description thereof will be omitted.

Figure 16:
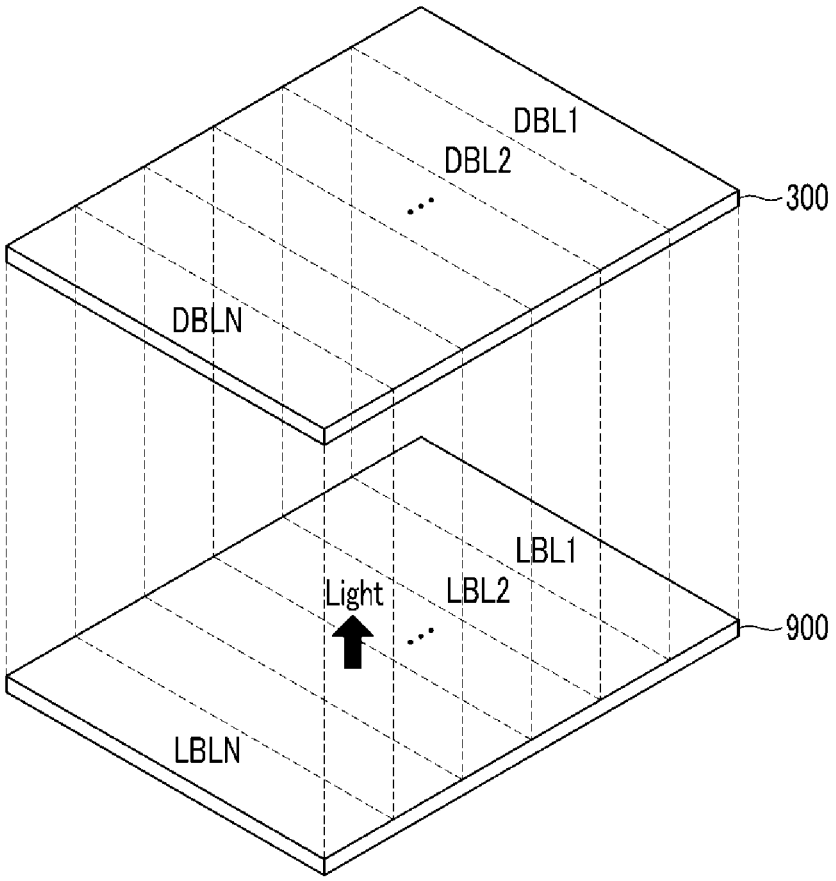
FIG. 16 is schematic exploded perspective view of a display device comprising a display panel and a backlight unit divided into a plurality of display blocks, according to an exemplary embodiment.
Figure 17:
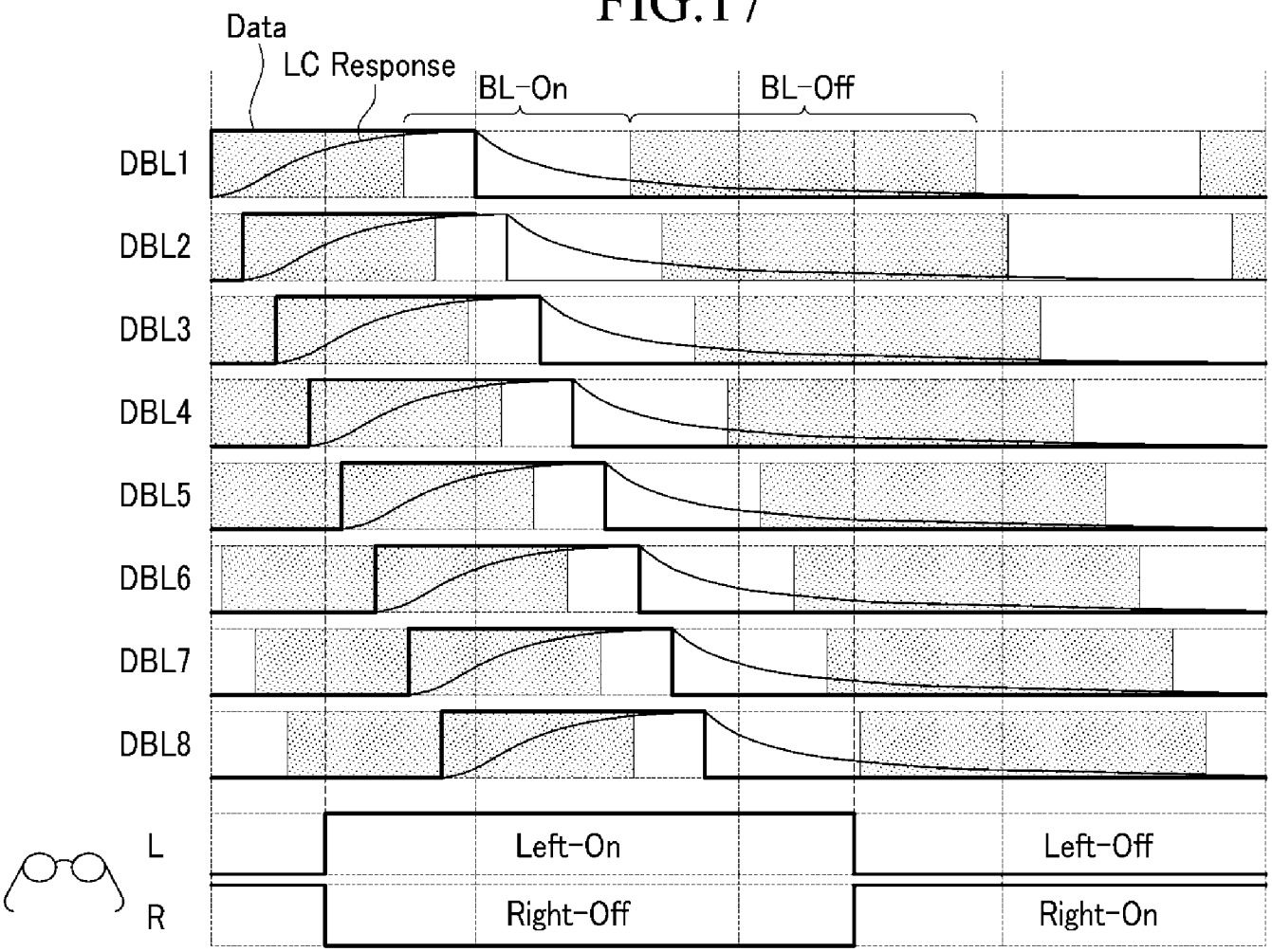
FIG. 17 is a timing chart of an illustrative driving signal of a display device, according to an exemplary embodiment.

An exemplary division and method of driving those divisions is described in more detail in association with FIGS. 16 and 17.

FIG. 16 is schematic exploded perspective view of a display device comprising a display panel and a backlight unit divided into a plurality of display blocks, according to an exemplary embodiment. FIG. 17 is a timing chart of an illustrative driving signal of a display device, according to an exemplary embodiment.

As seen in FIG. 16, the backlight unit 900, according to various exemplary embodiments, may be divided into a plurality of blocks LBL1, LBL2, . . . , and LBLN. The plurality of blocks LBL1, LBL2, . . . , and LBLN of the backlight unit 900 may respectively correspond to a plurality of light emitting blocks BL1, BL2, . . . , and BLN included in the aforementioned light source module 910*b*. As described above, since a plurality of light emitting blocks BL1, BL2, . . . , and BLN included in the light source module 910 may be each independently driven, a plurality of blocks LBL1, LBL2, . . . , and LBLN of the backlight unit 900 may be independently driven to emit light.

The display panel 300 may be divided into a plurality of display blocks DBL1, DBL2, . . . , and DBLN to correspond to a plurality of blocks LBL1, LBL2, . . . , and LBLN of the backlight unit 900. The plurality of display blocks DBL1, DBL2, . . . , and DBLN may be independently driven to receive image data. As shown, the number of blocks LBL1, LBL2, . . . , and LBLN of the backlight unit 900 and the number of display blocks DBL1, DBL2, . . . , and DBLN of the display panel 300 may be the same, but exemplary embodiments are not limited thereto. Namely, any suitable relationship between blocks LBL1, LBL2, . . . , and LBLN and display blocks DBL1, DBL2, . . . , and DBLN may be provided.

For example, according to a local dimming driving method to control luminance of light emitted from each block LBL1, LBL2, . . . , and LBLN of the backlight unit 900, a contrast ratio of a display image may be further maximized and a power consumption may be minimized by differently controlling the respective luminance of the blocks LBL1, LBL2, . . . , and LBLN according to the image data. In the display device including the light source module 910 of FIG. 16, since the backlight unit 900 or light source module 910 is divided into a plurality of blocks and driven based on the constitution of the blocks, the local dimming driving method may be implemented.

According to various exemplary embodiments, the display device of FIG. 16 may be configured as a three-dimensional (3D) display device. A method of driving such a 3D display device is described in more detail in association with FIG. 17.

FIG. 17 is a timing chart of an illustrative driving signal of a display device, according to an exemplary embodiment. With continued reference to FIG. 16, FIG. 17 illustrates recognition of a 3D image via shutter glasses including a left eye shutter "L" and a right eye shutter "R", but other stereoscopic techniques may be employed, such as one or more autostereoscopic display techniques. In this manner, another 3D image display device according to various other exemplary embodiments may differentiate a left eye image and a right eye image using a parallax barrier where a light blocking portion and a light transmitting portion are alternately formed.

In various exemplary embodiments, the display panel 300 of the display device of FIG. 16 may be divided into eight display blocks DBL1, . . . , and DBL8, but is not limited thereto. That is, any suitable number of display blocks may be provided. Accordingly, the backlight unit 900 may be divided into eight or a divisor/multiple of 8 blocks LBL1, LBL2, . . . , and LBL8.

If image data is sequentially received from the display block DBL1 disposed on the upper portion of the display panel 300, the image of luminance corresponding to the image data may be displayed in each display block DBL1, . . . , and DBL8. The image data may be image data for a left eye or image data for a right eye. According to various exemplary embodiments, the image data for the left eye and/or the image data for the right eye may be alternately displayed.

For example, in a case where the display device is a liquid crystal display including a liquid crystal layer (not shown) formed of liquid crystal molecules, then as shown in FIG. 17, the liquid crystal molecules may be re-arranged in response to the input of image data. When a response speed of the liquid crystal molecules is not rapid, then as shown in FIG. 17, a state where most liquid crystal molecules are reacted may be obtained a predetermined time after the image data is input.

Each block LBL1, . . . , and LBL8 of the backlight unit 900 may emit light during a light emitting section (BL-On) of a predetermined time when the reaction of the liquid crystal molecules of the corresponding display blocks DBL1, . . . , and DBL8 is almost finished. That is, each block LBL1, . . . , and LBL8 of the backlight unit 900 may emit light for a certain time a predetermined time after the image data is input to the corresponding display blocks DBL1, . . . , and DBL8. A section where each block LBL1, . . . , and LBL8 of the backlight unit 900 does not emit light may be referred to as a non-light emitting section (BL-Off).

If a plurality of blocks LBL1, . . . , and LBL8 of the backlight unit 900 sequentially emit light to allow a plurality of display blocks DBL1, . . . , and DBL8 of the display panel 300 to sequentially display the left eye image or right eye image, the left eye of the observer may receive the left eye image and the right eye may receive the right eye image through a stereoscopic image recognition member, such as via the aforementioned shutter glasses or parallax barriers operated to be synchronized therewith, and thereby, enable a viewer to recognize the 3D image.

For example, as shown in FIG. 17, while the display panel 300 receives the image data to display a left eye image, the left eye shutter "L" of the shutter glasses may be opened during a left eye shutter open section "Left-On" and the right eye shutter "R" may be closed during a right eye shutter close section "Right-Off", such that the left eye of the observer may recognize the left eye image via their left eye. Likewise, while the display panel 300 receives the image data to display a right eye image, the right eye shutter "R" of the shutter glasses may be opened during a right eye shutter open section "Right-On" and the left eye shutter "L" may be closed during a left eye shutter close section "Left-Off", such that the right eye of the observer may recognize the right eye image via their right eye. In FIG. 17, for convenience, illustration of the image data for the right eye has been omitted.

Accordingly, if the display panel 300 and the backlight unit 900 are divided into a plurality of blocks corresponding to each other to alternately display the left eye image and the right eye image, a cross-talk phenomenon where the left eye image and the right eye image overlap and are shown may be reduced.

Moreover, since color uniformity and color reproducibility can be improved, color stains can be prevented, and a light source module or a backlight unit can be divided into a plurality of blocks and individually driven, it is possible to provide a display device capable of implementing a local dimming driving method. In this manner, a display device displaying, for instance, a 3D image and/or the like may be provided with better display quality.

It will be apparent to those skilled in the art that various modifications and variations can be made without departing from the spirit or scope of the invention. Thus, it is intended that the present invention cover the modifications and variations provided they come within the scope of the appended claims and their equivalents.

What is claimed is:

1. A light source module, comprising: two first light source packages configured to emit light of a first color disposed at opposing lateral edges of a row including a plurality of light source packages;

one or more second light source packages disposed between the two first light source packages, the one or more second light source packages being configured to emit light of the first color; and a plurality of third light source packages disposed between the two first light source packages and alternately arranged with the one or more second light source packages, the plurality of third light source packages being configured to emit light of a second color, the second color being different than the first color, wherein an intensity of light emitted from each of the one or more second light source packages is approximately twice an intensity of light emitted from each of the two first light source packages, wherein at least one of the first light source packages is only disposed directly adjacent to one of the third light source packages that is disposed directly adjacent to one of the second light source packages.

2. The light source module of claim 1, wherein:

each of the two first light source packages comprises a number "n" of first light emitting elements, where "n" is a natural number of at least one; and each of the one or more second light source packages comprises a number "2n" of the first light emitting elements.

3. The light source module of claim 2, wherein:

the light source module is divided into a plurality of light emitting blocks, each of the light emitting blocks being configured to be separately driven to emit light; and each light emitting block comprises:

a number "2nk" of the first light emitting elements, where "k" is a natural number of at least one; and a number "k" of the third light source packages, each third light source package comprising at least one second lighting element.

4. The light source module of claim 2, wherein the first light source package and the second light source package further comprise one or more fluorescent bodies.

5. The light source module of claim 4, wherein:

the first light emitting elements are configured to emit light of a third color;

the one or more fluorescent bodies are configured to emit light of a fourth color; and the first color is a mixed color of the third color and the fourth color.

6. The light source module of claim 3, wherein:

the first light emitting elements associated with at least one of the plurality of light emitting blocks are connected in series to form at least one channel; and the second light emitting elements included in the at least one light emitting block are connected in series to form at least one other channel.

7. The light source module of claim 3, wherein:

a first half of the first light emitting elements included in at least one of the one or more second light source packages is associated with a first light emitting block among the plurality of light emitting blocks; and a second half of the at least one second light source package is included in a second light emitting block adjacent to the first light emitting block.

8. The light source module of claim 7, wherein a light emitting block disposed at an edge of the plurality of light emitting blocks comprises:

one of the two first light source packages;

half of the first light emitting elements associated with at least one of the one or more second light source packages; and at least one of the plurality of third light source packages.

9. The light source module of claim 8, wherein:

those first light emitting elements associated with a light emitting block are connected in series to form at least one channel; and those second light emitting elements associated with the light emitting block are connected in series to form at least one other channel.

10. The light source module of claim 9, wherein at least one of the two first light source packages and at least one of the one or more second light source packages further comprise one or more fluorescent bodies.

11. The light source module of claim 10, wherein:

the first light emitting elements are configured to emit light of a third color;

the one or more fluorescent bodies are configured to emit light of a fourth color; and the first color is a mixed color of the third color and the fourth color.

12. A display device, comprising: a display panel comprising a plurality of pixels configured to receive image data; and a backlight unit configured to radiate light towards the display panel, the backlight unit comprising a light source module, wherein the light source module comprises:

two first light source packages configured to emit light of a first color disposed at opposing lateral edges of a row including a plurality of light source packages, one or more second light source packages disposed between the two first light source packages, the one or more second light source packages being configured to emit light of the first color, and a plurality of third light source packages disposed between the two first light source packages and alternately arranged with the one or more second light source packages, the plurality of third light source packages being configured to emit light of a second color, the second color being different than the first color, wherein an intensity of light emitted from each of the one or more second light source packages is approximately twice an intensity of light emitted from each of the two first light source packages, and wherein at least one of the first light source packages is only disposed directly adjacent to one of the third light source packages that is disposed directly adjacent to one of the second light source packages.

13. The display device of claim 12, wherein:

each of the two first light source packages comprises a number "n" of first light emitting elements, where "n" is a natural number of at least one; and each of the one or more second light source packages comprises a number "2n" of the first light emitting elements.

14. The display device of claim 13, wherein:

the light source module is divided into a plurality of light emitting blocks, each of the light emitting blocks being configured to be separately driven to emit light; and each light emitting block comprises:

a number "2nk" of the first light emitting elements, where "k" is a natural number of at least one; and a number "k" of the third light source packages, each third light source package comprising at least one second lighting element.

15. The display device of claim 14, wherein:

a first half of the first light emitting elements included in at least one of the one or more second light source packages is associated with a first light emitting block among the plurality of light emitting blocks; and a second half of the at least one second light source package is included in a second light emitting block adjacent to the first light emitting block.

16. The display device of claim 14, wherein the display panel is divided into a plurality of display blocks corresponding to the plurality of light emitting blocks, the display panel being configured to:

display, respectively, images in association with the plurality of display blocks, wherein the display device is configured to independently control luminance of light emitted from respective ones of the plurality of light emitting blocks based on image data input to the plurality of display blocks.

17. The display device of claim 14, wherein the display panel is divided into a plurality of display blocks corresponding to the plurality of light emitting blocks, the display panel being configured to:

display, respectively, images in association with the plurality of display blocks, wherein each of the plurality of light emitting blocks are configured to emit light a predetermined time after image data is input to a corresponding one of the plurality of display blocks.

18. The display device of claim 15, wherein a light emitting block disposed at an edge of the plurality of light emitting blocks comprises:

one of the two first light source packages;

half of the first light emitting elements associated with at least one of the one or more second light source packages; and at least one of the plurality of third light source packages.

19. The display device of claim 18, wherein:

those first light emitting elements associated with a light emitting block are connected in series to form at least one channel; and those second light emitting elements associated with the light emitting block are connected in series to form at least one other channel.

20. The display device of claim 19, wherein at least one of the two first light source packages and at least one of the one or more second light source packages further comprise one or more fluorescent bodies.

21. The display device of claim 20, wherein:

the first light emitting elements are configured to emit light of a third color;

the one or more fluorescent bodies are configured to emit light of a fourth color; and the first color is a mixed color of the third color and the fourth color.

* * * * *